US012150553B2

(12) United States Patent
Lofton

(10) Patent No.: US 12,150,553 B2
(45) Date of Patent: Nov. 26, 2024

(54) ACCESSORY SUPPORT ATTACHMENT FOR COOLERS

(71) Applicant: Matthew Lofton, Homestead, FL (US)

(72) Inventor: Matthew Lofton, Homestead, FL (US)

( * ) Notice: Subject to any disclaimer, the term of this patent is extended or adjusted under 35 U.S.C. 154(b) by 28 days.

(21) Appl. No.: 17/550,511

(22) Filed: Dec. 14, 2021

(65) Prior Publication Data

US 2023/0180938 A1 Jun. 15, 2023

(51) Int. Cl.
*A47C 13/00* (2006.01)
*A47C 7/42* (2006.01)
*F25D 3/08* (2006.01)

(52) U.S. Cl.
CPC ..... *A47C 13/00* (2013.01); *A47C 7/42* (2013.01); *F25D 3/08* (2013.01)

(58) Field of Classification Search
CPC .. A47C 13/00; A47C 7/42; A47C 9/00; F25D 3/08
See application file for complete search history.

(56) References Cited

U.S. PATENT DOCUMENTS 3,659,369 A * 5/1972 Hermanson ..... A01K 97/10 43/21.2
6,550,791 B2 4/2003 Ramsey
7,140,507 B2 11/2006 Maldonado et al.
7,389,608 B1 6/2008 MacKay
7,472,510 B1 1/2009 Fasola
8,375,622 B1 * 2/2013 Holzmann, Jr. ..... A01K 97/10 43/21.2
8,925,752 B2 1/2015 Smith
9,316,428 B2 4/2016 Mech
9,913,464 B1 3/2018 Stokes
10,154,660 B1 12/2018 Matthews et al.
10,429,116 B2 10/2019 Huish
10,499,744 B2 12/2019 Becker et al.
2015/0150231 A1 * 6/2015 Norman ..... A01K 97/04 43/17.5
2016/0242552 A1 8/2016 Makos
2018/0306226 A1 * 2/2018 Huish ..... F25D 3/06
2023/0257163 A1 * 8/2023 Fleherty et al. ..... B65D 81/38 220/592.2

* cited by examiner

*Primary Examiner* — Elizabeth J Martin
*Assistant Examiner* — Dario Antonio DeLeon
(74) *Attorney, Agent, or Firm* — Johnson | Dalal; Mark C. Johnson

(57) ABSTRACT

An accessory support attachment for coolers that is selectively couplable thereto and operably configured to support accessories thereon, the attachment comprising a support sidewall of a substantially rigid material with a first portion hingedly and lockably couplable to a second portion, at least one accessory support member selectively and slidably coupled to an outer surface of the support sidewall, a first and second plurality of enclosures coupled to the accessory support member and operably configured to retain accessories therein, a handle member designed to facilitate greater ease of transport of coolers, and a back support frame member operably configured to function as a backrest and support the weight of a user when seated on the cooler and leaning back, on, or against the back support frame member.

10 Claims, 12 Drawing Sheets

ACCESSORY SUPPORT ATTACHMENT FOR COOLERS

FIELD OF THE INVENTION

The present invention relates generally to attachments for coolers and, more particularly, relates to cooler attachments that are selectively couplable and uncouplable thereto and that are operably configured to support accessories thereon.

BACKGROUND OF THE INVENTION

Coolers have grown in use and popularity over time, particularly in the context of personal or recreational use. However, the versatility of coolers has remained substantially stagnant such that they are principally only used for a single purpose, i.e., to keep consumable products cool or warm. To that end, a cooler may be any insulated box used to keep food or drink cool or warm. As coolers are typically used when a user is outside (and away from refrigerators, freezers, and other appliances that require an electrical outlet source), comfortable seating is typically hard to come by and users routinely use the top surface of coolers as seating surfaces. While such use certainly broadens and expands upon the versatility of existing coolers, it does not provide a comfortable seating option for users and is, therefore, characterized by substantial limitations. Removable or attachable cooler seat cushions provide a more plush or comfortable surface on which users can sit but fail to provide any type of structural support, i.e., users are unable to lean back, on, or against any accompanying backrest or rail. These drawbacks significantly diminish the comfort and convenience of coolers as temporary or makeshift seating areas. Further, existing cooler accessories or add-ons are generally not operably configured to retain and support accessories thereon.

Therefore, a need exists to overcome the problems with the prior art as discussed above.

SUMMARY OF THE INVENTION

The invention provides an accessory support attachment for coolers that overcomes the hereinafore-mentioned disadvantages of the heretofore-known devices and methods of this general type and that affords users a selectively couplable cooler attachment that structurally supports use of the cooler as a seating surface or support member. Specifically, the present invention provides a compact solution (as the accessory support attachment rests around the outside perimeter of a cooler) that greatly expands the versatility of existing cooler assemblies. The accessory support attachment may be utilized to convert a cooler into a temporary seating surface with an accompanying backrest or frame for added comfort and ease of use and may also be utilized, by way of example and without limitation, as a fishing rod holder or hold frame.

With the foregoing and other objects in view, there is provided, in accordance with the invention, an accessory support attachment for coolers comprising a support sidewall of a substantially rigid material, with an upper edge, with a lower edge opposing the upper edge, with an inner surface, with an outer surface opposing the inner surface of the support sidewall, with a first portion including a first portion first end and a first portion second end opposing the first portion first end, with a second portion including a second portion first end hingedly coupled to the first portion first end and a second portion second end opposing the second portion first end and selectively and lockably couplable to the first portion second end with at least one support sidewall fastener assembly, and with a sidewall length separating the first portion first end and the first portion second end; and an accessory support member selectively and slidably coupled to the outer surface of the support sidewall with a tongue-and-groove configuration, with a first accessory support first end, with a first accessory support second end, and with an accessory support length separating the first accessory support first end and the first accessory support second end, the accessory support length at least 50% of the sidewall length.

In accordance with a further feature of the present invention, the at least one support sidewall fastener assembly further comprises a rear plate mechanically coupled with at least one fastener to the first portion and proximal to the second portion second end; a flange member extending radially outward from the outer surface of the second portion of the support sidewall and disposed proximal to the second portion second end; and a front plate translatably coupled to the rear plate and selectively and lockably couplable to the flange member.

In accordance with a further feature of the present invention, the accessory support attachment for coolers may further comprise a second accessory support member selectively and slidably coupled to the outer surface of the second portion of the support sidewall with a tongue-and-groove configuration, with a second accessory support first end, with a second accessory support second end, and with a second accessory support length separating the second accessory support first end and the second accessory support second end, the second accessory support length at least 50% of the sidewall length and the accessory support member selectively and slidably coupled to the outer surface of the first portion of the support sidewall with the tongue-and-groove configuration.

In accordance with a further feature of the present invention, the accessory support length and the second accessory support length are substantially equal.

In accordance with one embodiment of the present invention, the accessory support member is selectively and slidably coupled to the first portion and the second accessory support member is selectively and slidably coupled to the outer surface of the second portion on an opposing side of the support sidewall.

In accordance with another feature, the accessory support member and the second accessory support member are oriented in a parallel configuration with one another.

In accordance with another feature, an embodiment of the present invention also includes a first plurality of enclosures each angled outwardly and upwardly from the upper edge of the support sidewall, with a bottom wall, and with an upper enclosed aperture, the first plurality of enclosures coupled to the accessory support member in a cantilevered configuration; and a second plurality of enclosures each angled outwardly and upwardly from the upper edge of the support sidewall, with a bottom wall, and with an upper enclosed aperture, the second plurality of enclosures coupled to the second accessory support member in a cantilevered configuration.

In accordance with yet another feature, another embodiment of the present invention includes a handle member angled outwardly and upwardly from the upper edge of the support sidewall, with a first handle end selectively removably coupled to the accessory support member in a cantilevered configuration and with a fastener, and a second handle end selectively removably coupled to the accessory support member in a cantilevered configuration and with a fastener.

In accordance with a further feature of the present invention, yet another embodiment of the present invention includes a back support frame member each angled outwardly and upwardly from the upper edge of the support sidewall and coupled to the accessory support member in a cantilevered configuration, the support frame member having a deformably resilient pad coupled thereto.

In accordance with another feature, the deformably resilient pad further comprises two opposing ends defining a pad length separating the two opposing ends of the deformably resilient pad, the pad length at least 50% of the sidewall length.

In accordance with an embodiment of the present invention, the accessory support attachment for coolers further comprises a cooler support latch extending upwardly from the upper edge of the support sidewall, coupled to the support sidewall, and having a U-shaped free end.

In accordance with another embodiment, the accessory support attachment for coolers comprises a lower support hook extending downwardly from the lower edge of the support sidewall, coupled to the support sidewall, and having a U-shaped free end.

In accordance with the present invention, an improvement used in combination with a cooler having a cooler bottom wall, a cooler sidewall surrounding the cooler bottom wall and defining, with the cooler bottom wall, an insulated cooling cavity, and a lid selectively and removably coupled to the cooler sidewall and operably configured to encapsulate, with the cooler sidewall and cooler bottom wall, the insulated cooling cavity, the improvement comprising an accessory support attachment for coolers having a support sidewall of a substantially rigid material, and selectively removably couplable to the cooler sidewall in a compression configuration, with an upper edge, with a lower edge opposing the upper edge, with an inner surface, with an outer surface opposing the inner surface of the support sidewall, with a first portion including a first portion first end and a first portion second end opposing the first portion first end, with a second portion including a second portion first end hingedly coupled to the first portion first end and a second portion second end opposing the second portion first end and selectively and lockably couplable to the first portion second end with at least one support sidewall fastener assembly, and with a sidewall length separating the first portion first end and the first portion second end; and an accessory support member selectively and slidably coupled to the outer surface of the support sidewall with a tongue-and-groove configuration, with a first accessory support first end, with a first accessory support second end, and with an accessory support length separating the first accessory support first end and the first accessory support second end, the accessory support length at least 50% of the sidewall length.

In accordance with a further feature, the improvement further comprises a second accessory support member selectively and slidably coupled to the outer surface of the second portion of the support sidewall with a tongue-and-groove configuration, with a second accessory support first end, with a second accessory support second end, and with a second accessory support length separating the second accessory support first end and the second accessory support second end, the second accessory support length at least 50% of the sidewall length and the accessory support member selectively and slidably coupled to the outer surface of the first portion of the support sidewall with the tongue-and-groove configuration.

In accordance with yet another feature, the improvement also comprises a back support frame member each angled outwardly and upwardly from the upper edge of the support sidewall and coupled to the accessory support member in a cantilevered configuration, the support frame member having a deformably resilient pad coupled thereto.

Although the invention is illustrated and described herein as embodied in an accessory support attachment for coolers, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the accessory support attachment. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
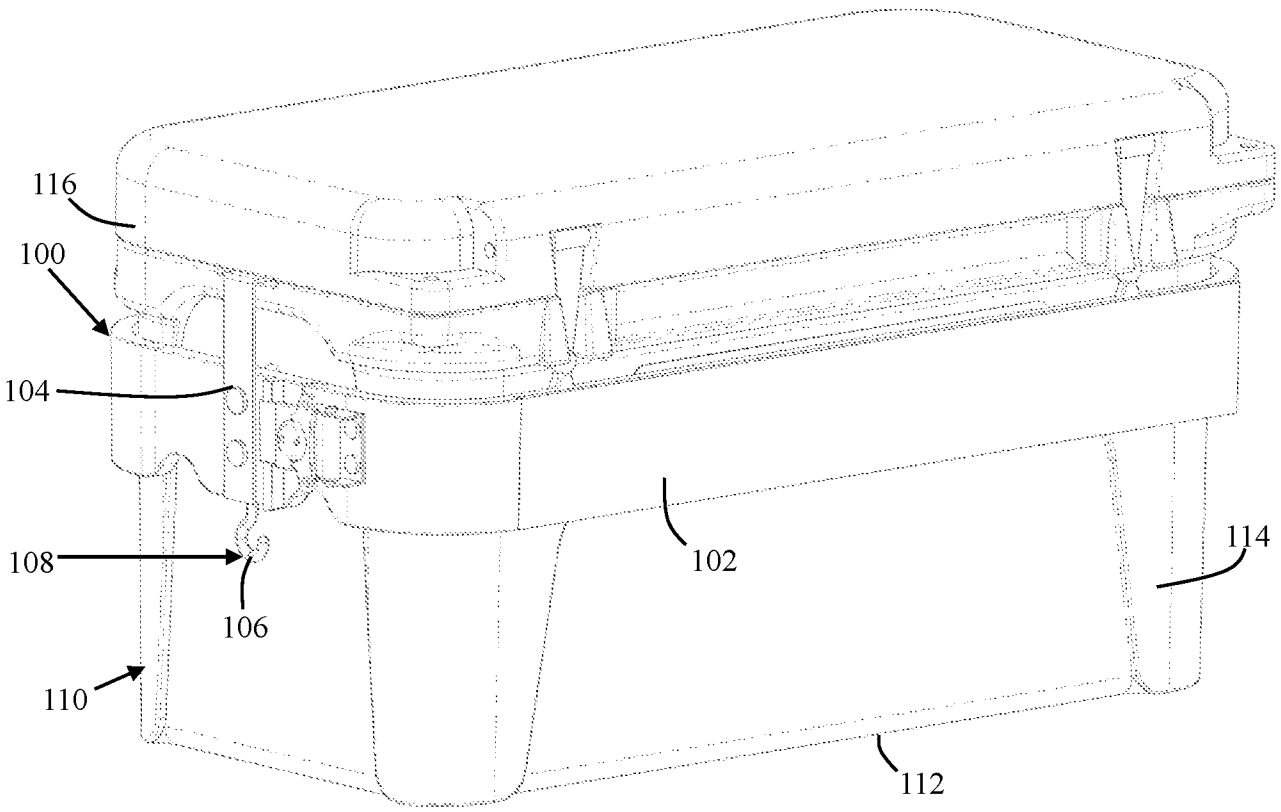
FIG. 1 is a perspective side view of an accessory support attachment coupled to a cooler, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel, compact, and versatile accessory support attachment for coolers that structurally supports use of the cooler as a seating surface or support member. Embodiments of the invention provide an attachment that may be utilized to convert a cooler into a temporary seating surface with an accompanying backrest or frame for added comfort and ease of use and may also be utilized, by way of example and without limitation, as a fishing rod holder or hold frame. In addition, embodiments of the invention provide a handle member that facilitates a greater ease of transporting coolers using the accessory support attachment and a plurality of enclosures operably configured to store fishing rods and other elongated items that do not otherwise fit within a cooler.

Figure 2:
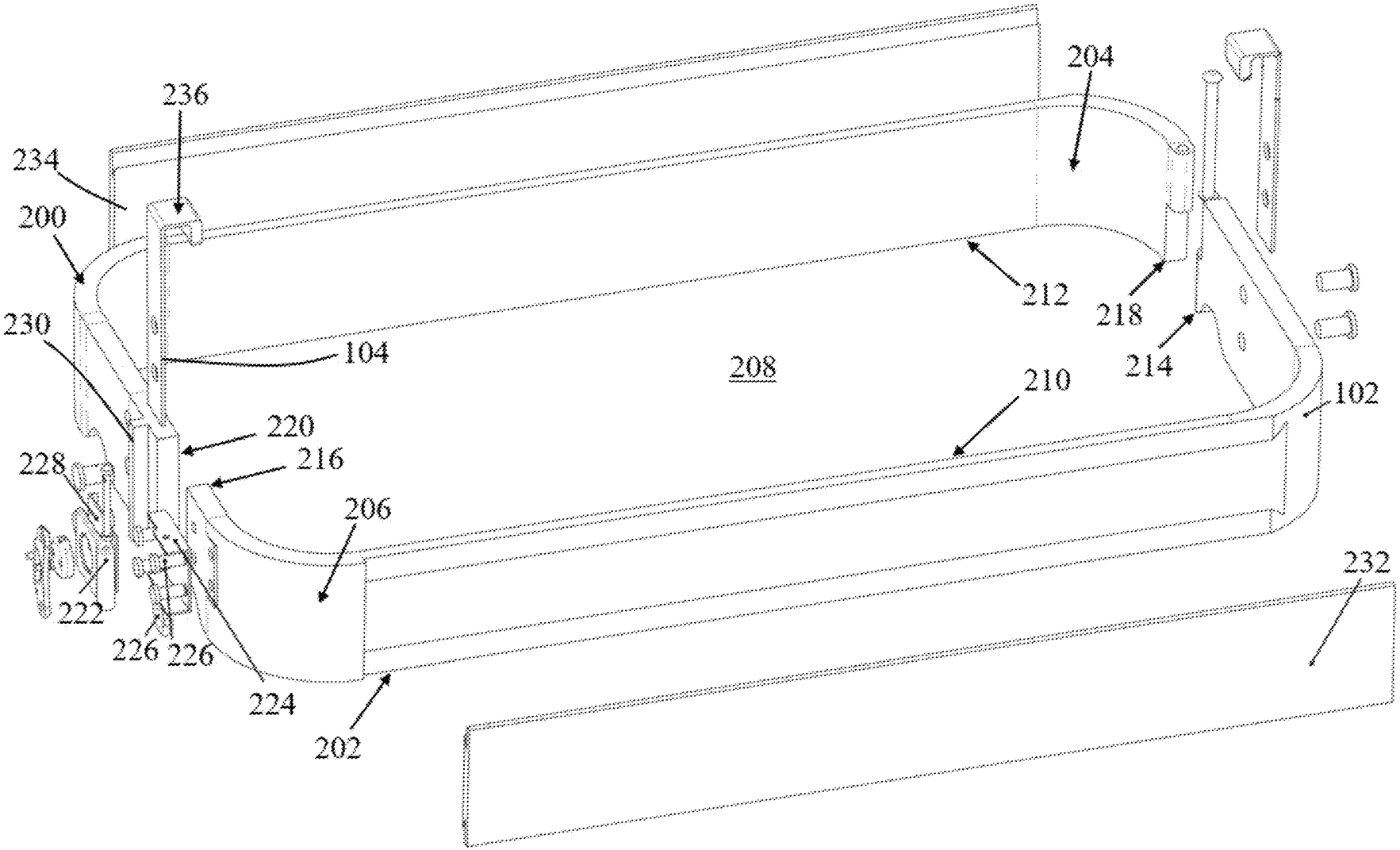
FIG. 2 is a perspective top view of a support sidewall, accessory support member, and second accessory support member, in accordance with the present invention.
Figure 3:
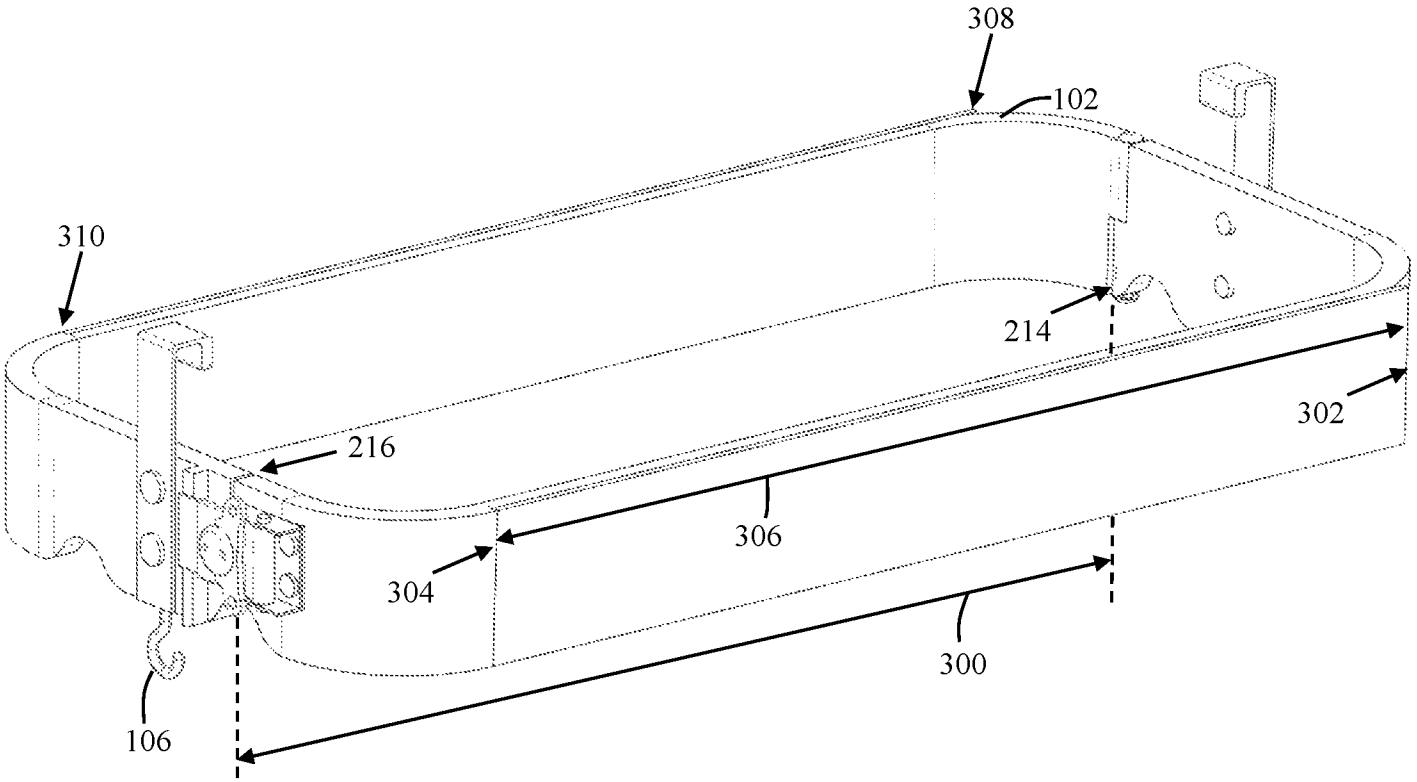
FIG. 3 is a perspective side view of the exemplary embodiment of an accessory support attachment, in accordance with the present invention.
Figure 14:
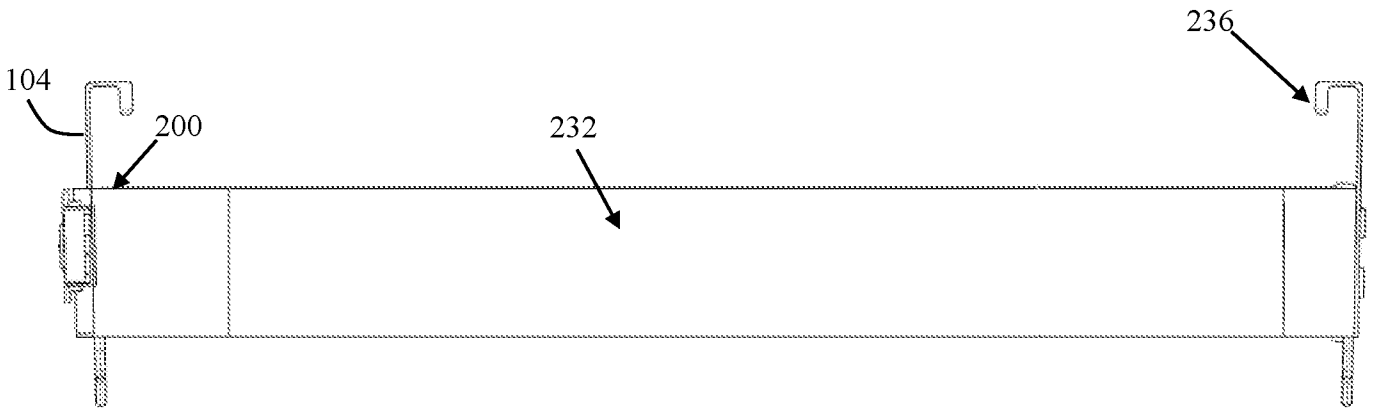
FIG. 14 is an elevational front view of an exemplary embodiment of the accessory support attachment, in accordance with the present invention.
Figure 16:
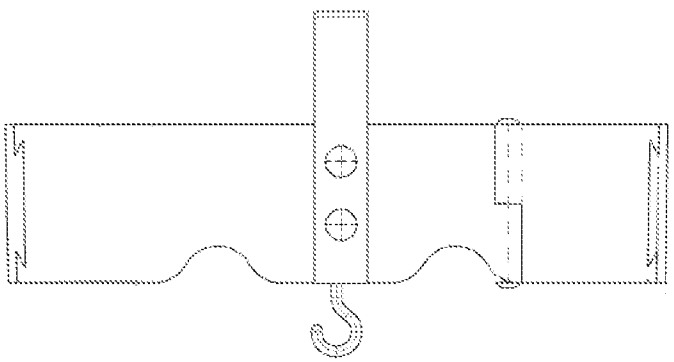
FIGS. 15-16 are elevational side views of the accessory support attachment, in accordance with the present invention.
Figure 15:
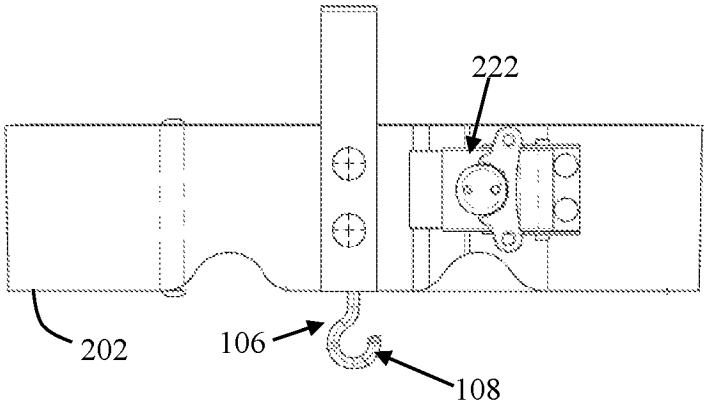

Referring now to FIG. 1, one embodiment of the present invention is shown in a perspective side view. FIG. 1 shows several advantageous features of the present invention, but, as will be described below, the invention can be provided in several shapes, sizes, combinations of features and components, and varying numbers and functions of the components. The first example of an accessory support attachment for coolers 100 ("attachment 100"), as shown in FIGS. 1-2, includes a support sidewall 102 of a substantially rigid material, with an upper edge 200, with a lower edge 202 opposing the upper edge 200, with an inner surface 204, with an outer surface 206 opposing the inner surface 204 of the support sidewall 102, with a first portion 210 (also referred to as a first sidewall member 210) including a first portion first end 214 and a first portion second end 216 opposing the first portion first end 214, with a second portion 212 including a second portion first end 218 hingedly coupled to the first portion first end 214 to horizontally align the first and second sidewall members (as best seen in FIGS. 14-16) and a second portion second end 220 opposing the second portion first end 218 and selectively and lockably couplable to the first portion second end 216 with at least one support sidewall fastener assembly 222, and with a sidewall length 300 separating the first portion first end 214 and the first portion second end 216. As used herein, the phrase "substantially rigid material" means that the first and second portions 210, 212 maintain their shape when they are separated from one another. Said another way, the first and second portions 210, 212 are made of a substantially rigid material separating the respective sidewall length and second portion length such that the first and second portions maintain their shape and horizontal alignment (as best seen in FIG. 2) when the second portion second end is uncoupled from the first portion second end. In an exemplary embodiment, the support sidewall 102 is of a high-density polyethylene (HDPE) composition that is durable, versatile, and abrasion and chemically resistant to withstand repeated and continued use and, more specifically, to structurally support a user's weight during use. The sidewall length 300 is best depicted in FIG. 3 and is between approximately 24 and 26 inches in preferred embodiments, reflecting the typical length of coolers in the industry, so as to enable the support sidewall 102 to fit around the entirety of the perimeter of existing coolers. As seen in FIGS. 1-2, the inner surface 204 of support sidewall 102 can also be seen defining an area 208 where the cooler 110 is disposed therein.

Referring now to FIGS. 2-3, the attachment 100 further includes an accessory support member 232 selectively and slidably coupled to the outer surface 206 of the support sidewall 102 with a tongue-and-groove configuration, with a first accessory support first end 302, with a first accessory support second end 304, and with an accessory support length 306 separating the first accessory support first end 302 and the first accessory support second end 304, the accessory support length 306 at least 50% of the sidewall length 300. The accessory support length 306 is best depicted in FIG. 3 and is between approximately 19 and 22 inches in preferred embodiments, reflecting the typical length of coolers in the industry, so as to enable the support sidewall 102 to fit around the entirety of the perimeter of existing coolers and to provide a surface sufficient to support the weight experienced by the accessory support member 232, e.g., fishing poles, a seat backing, etc. Similarly, the accessory support length 306 is at least 50% of the sidewall length 300 because a sufficient surface is needed to support the weight experienced by the accessory support member 232 during use. This may include the weight of the user when sitting on the cooler, the additional components of the attachment 100 (e.g., the seat backing), and the additional items placed in or on the attachment 100 (e.g., fishing poles). In an exemplary embodiment, the accessory support member 232 is of a high-density polyethylene (HDPE) composition that is durable, versatile, and abrasion and chemically resistant to withstand repeated and continued use and to structurally support a user's weight during use.

It should be understood that terms such as, "front," "rear," "side," "top," "bottom," and the like are indicated from the reference point of a viewer viewing the accessory support attachment 100 from its support sidewall 102 with the accessory support member 232 facing the viewer (see FIGS. 1-2).

In one embodiment, the at least one support sidewall fastener assembly 222 may include a rear plate 224 mechanically coupled with at least one fastener 226 to the first portion 210 and proximal to the second portion second end 216. As seen in FIG. 2, the at least one fastener 226 is a steel screw in an exemplary embodiment but may be another comparable fastener, e.g., nails, nuts and bolts, anchors, rivets, etc., in alternate embodiments. The at least one support sidewall fastener assembly 222 further comprises a flange member 230 extending radially outward from the outer surface 206 of the second portion 212 of the support sidewall 102 and disposed proximal to the second portion second end 220; and a front plate 228 translatably coupled to the rear plate 224 and selectively and lockably couplable to the flange member 230. The front plate 228 may rotate or slide with respect to the rear plate 224 and lockably couples to the flange member 230 for added structural support. The front and rear plates 228, 224 are preferably of a steel composition to provide sufficient structural support to the weight placed on the attachment 100.

As seen in FIG. 3, the attachment 100 may also include a second accessory support member 234 selectively and slidably coupled to the outer surface 206 of the second portion 212 of the support sidewall 102 with a tongue-and-groove configuration, with a second accessory support first end 308, with a second accessory support second end 310, and with a second accessory support length 306 separating the second accessory support first end 308 and the second accessory support second end 310, the second accessory support length at least 50% of the sidewall length 300 and the accessory support member 232 selectively and slidably coupled to the outer surface 206 of the first portion 210 of the support sidewall 102 with the tongue-and-groove configuration. Similar to the accessory support member 232, the second accessory support member 234 is operably configured to bear and support at least a portion of the weight placed on it by virtue of the items placed on the attachment 100 or the weight placed on attachment 100 when a user sits on the cooler and leans on or against the attachment 100. For this reason, the accessory support length 306 and the second accessory support length may be substantially equal, i.e., between approximately 19 and 22 inches in preferred embodiments.

Figure 4:
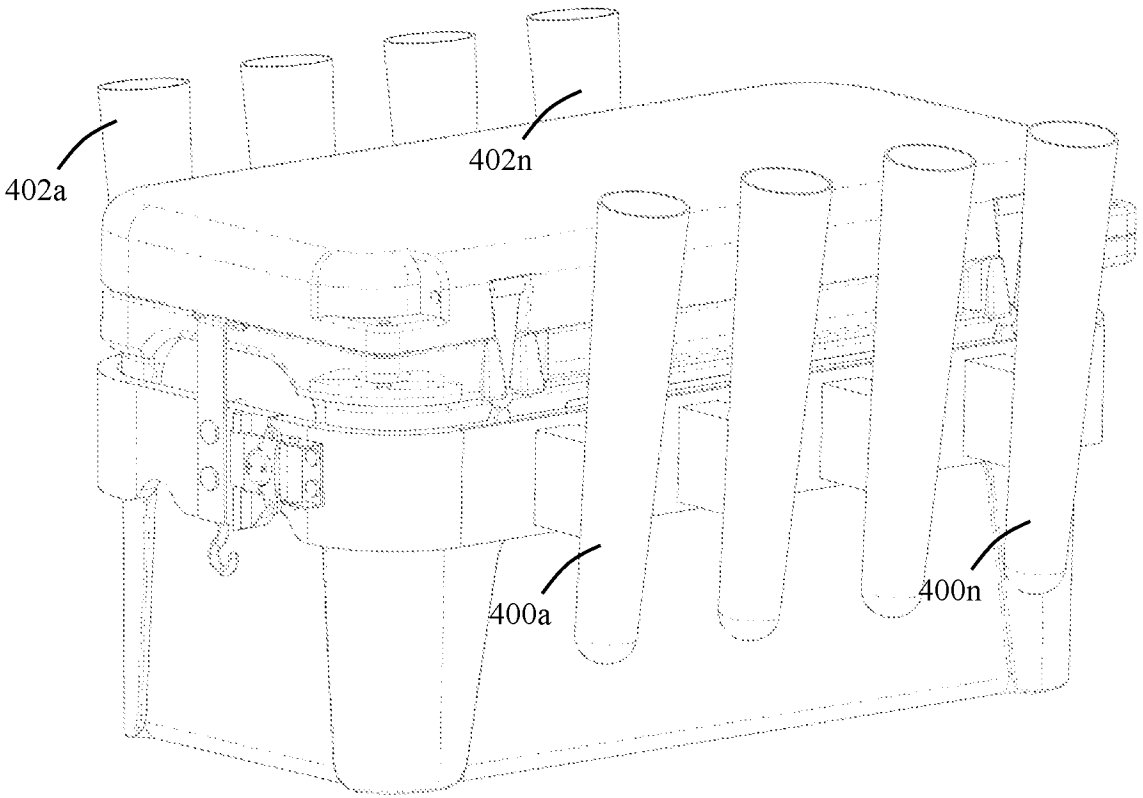
FIG. 4 is a perspective side view of the accessory support attachment with a first and second plurality of enclosures, in accordance with the present invention.

In one embodiment, the accessory support member 232 is selectively and slidably coupled to the first portion 210 and the second accessory support member 234 is selectively and slidably coupled to the outer surface 206 of the second portion 212 on an opposing side of the support sidewall 102, beneficially allowing items, e.g., fishing rods, to be selectively, removably, and simultaneously placed on both the accessory support member 232 and the second accessory support member 234 (as seen in FIG. 4). This feature beneficially improves the overall utility of the attachment 100 as both sides of the cooler, i.e., the first portion 210 and the second portion 212, may be utilized simultaneously by a user. Accordingly, the accessory support member 232 and the second accessory support member 234 are oriented in a parallel configuration with one another in one embodiment of the present invention.

Figure 5:
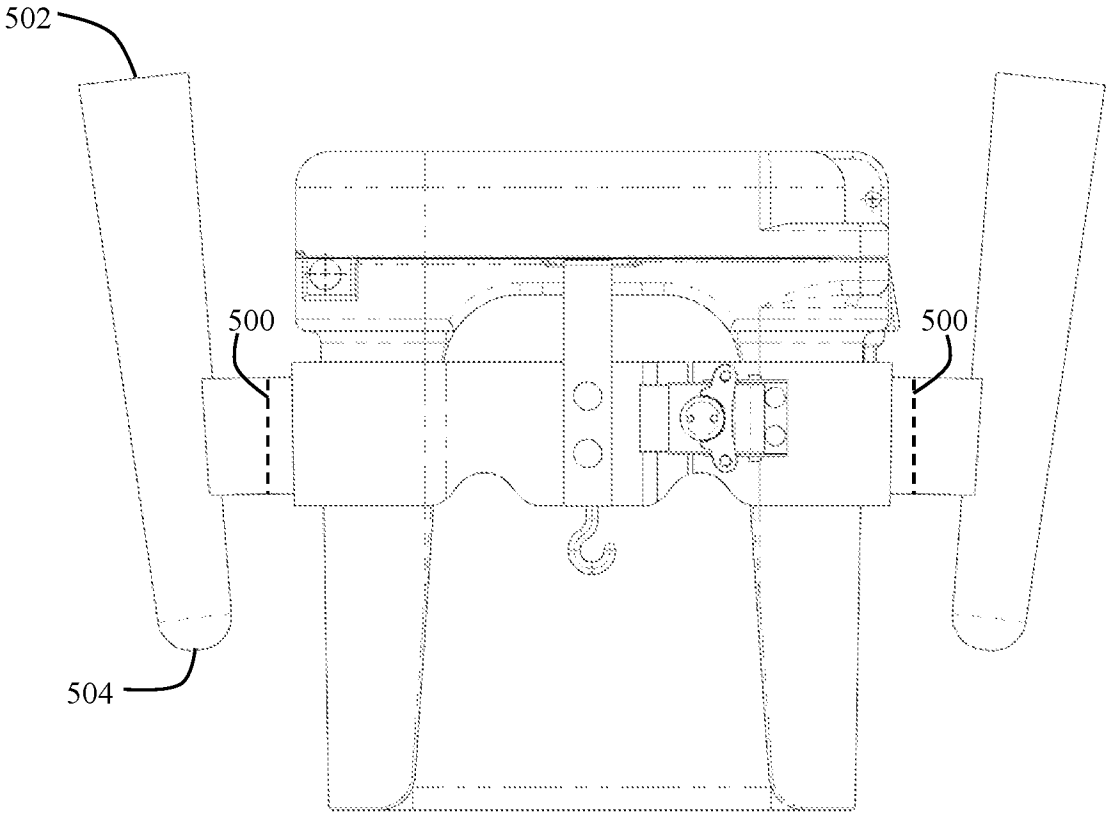
FIG. 5 is an elevational side view of the accessory support attachment with a first and second plurality of enclosures, in accordance with the present invention.
Figure 6:
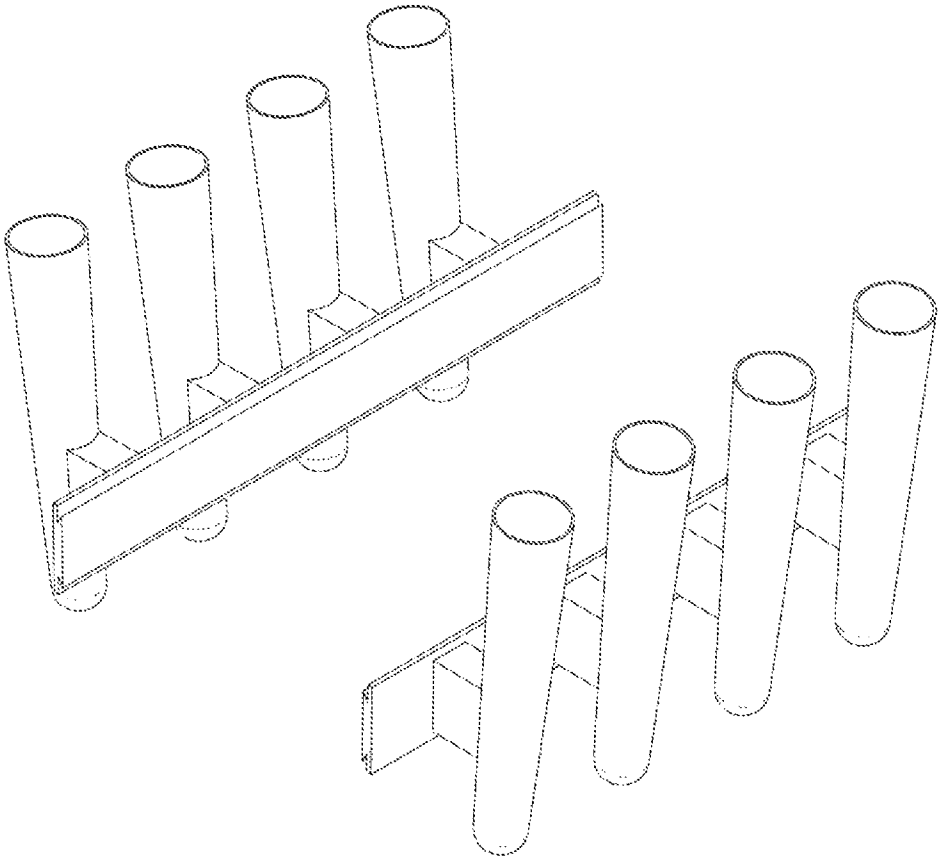
FIG. 6 is a perspective top view of the first and second plurality of enclosures, in accordance with an exemplary embodiment of the present invention.

To facilitate the temporary storage of items typically used in conjunction or in connection with a cooler, e.g., fishing rods, the attachment 100 may also include a first plurality of enclosures 400*a-n* each angled outwardly and upwardly from the upper edge 200 of the support sidewall 102, with a bottom wall, and with an upper enclosed aperture, the first plurality of enclosures 400*a-n* coupled to the accessory support member 232 in a cantilevered configuration; and a second plurality of enclosures 402*a-n* each angled outwardly and upwardly from the upper edge 200 of the support sidewall 102, with a bottom wall, and with an upper enclosed aperture, the second plurality of enclosures 402*a-n* coupled to the second accessory support member 234 in a cantilevered configuration. By virtue of the cantilevered configuration of the first and second plurality of enclosures 400*a-n*, 402*a-n*, the first and second plurality of enclosures 400*a-n*, 402*a-n* are structurally supported only on one end or side. Exemplary embodiments of the first and second plurality of enclosures 400*a-n*, 402*a-n* are best depicted in FIGS. 4-6. As seen in FIG. 6, the first and second plurality of enclosures 400*a-n*, 402*a-n* may taper in diameter from the upper enclosed aperture so as to facilitate the angled configuration of the first and second plurality of enclosures 400*a-n*, 402*a-n* outwardly and upwardly away from the upper edge 200 of the support sidewall 102. Preferably, the first and second plurality of enclosures 400*a-n*, 402*a-n* form an angle approximately between 900 and 950 degrees with respect to the accessory support member 232 and the second accessory support member 234, respectively. In one embodiment, the first and second plurality of enclosures 400*a-n*, 402*a-n* are approximately between 11 inches and 13 inches in length. To that end, the length of the first and second plurality of enclosures 400*a-n*, 402*a-n* may be approximately two to three times that of an accessory support member width 500 (as seen in FIG. 5), the accessory support member width 500 being approximately 3 inches in an exemplary embodiment. In some embodiments, the accessory support member width 500 may separate an enclosure upper edge 502 from an enclosure lower edge 504. The length of the first and second plurality of enclosures 400*a-n*, 402*a-n* must be sufficiently long to support the weight of the items placed therein, particularly those having an extended length, e.g., fishing rods, and the diameter of the first and second plurality of enclosures 400*a-n*, 402*a-n* must be sufficiently wide to enable such items to be easily placed inside the first and second plurality of enclosures 400*a-n*, 402*a-n* without any substantial obstruction or resistance. For this reason, the diameter of the first and second plurality of enclosures 400*a-n*, 402*a-n* tapers between approximately 1.55 inches at the enclosure lower edge 504 and 2.3 inches at the enclosure upper edge 502.

Figure 13:
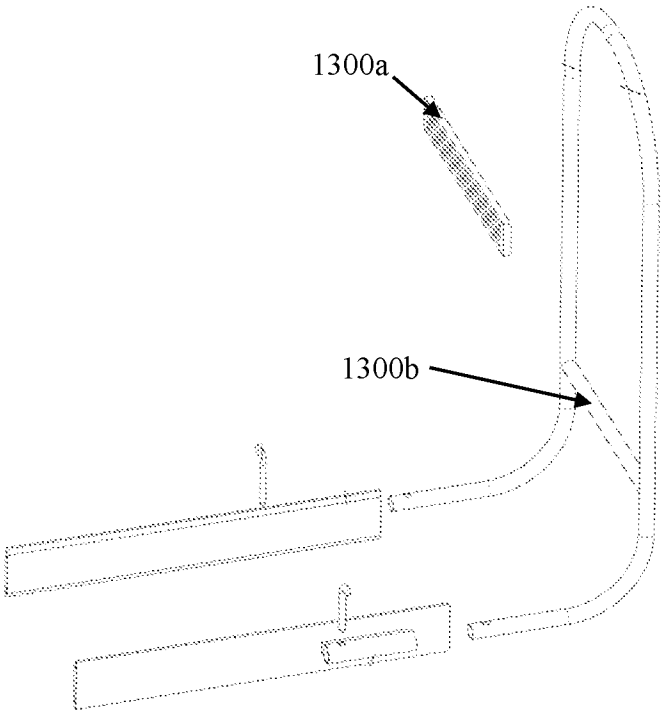
FIG. 13 is a partially exploded perspective side view of the handle member and the first and second accessory support members, in accordance with the present invention.
Figure 12:
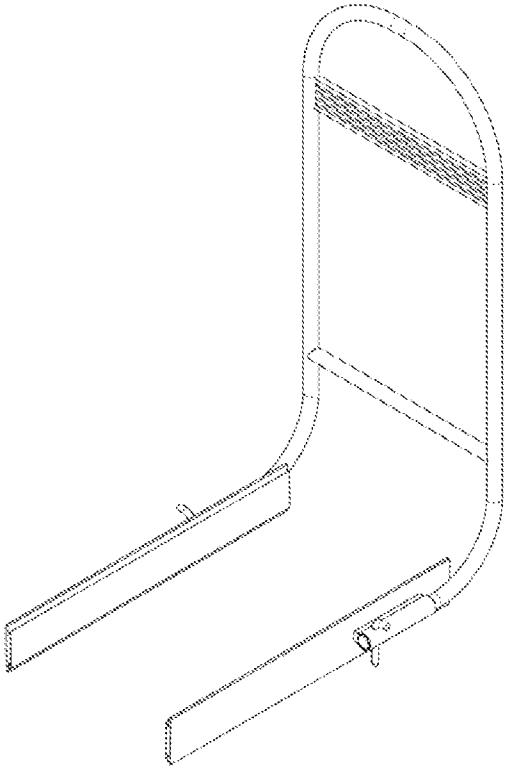
FIG. 12 is a perspective top view of a handle member coupled to the first and second accessory support members, in accordance with the present invention.

As depicted in FIGS. 10-13, the attachment 100 may also include a handle member 1000 angled outwardly and upwardly from the upper edge 200 of the support sidewall 102, with a first handle end 1100 selectively removably coupled to the accessory support member 232 in a cantilevered configuration, i.e., supported only on one end or side, and with a fastener 1104, and a second handle end 1102 selectively removably coupled to the accessory support member 234 in a cantilevered configuration, i.e., supported only on one end or side, and with a fastener 1106. In an exemplary embodiment, the fasteners 1104, 1106 consist of locking steel pins (and guides proportionately sized and shaped to receive the locking pins) but the fasteners 1104, 1106 may be other comparable fasteners, e.g., nails, screws, nuts and bolts, anchors, rivets, etc., in alternate embodiments. The locking guides consist of cylindrical members coupled to the support members 232, 234 and proportionately sized and shaped to receive the handle ends 1100, 1102 therein for added stability and support. The handle member 1000 may beneficially be used to selectively move or transport the cooler to which the attachment 100 is coupled or may be used as a backrest when a user is sitting on the cooler and leans back, on, or against the handle member 1000. Exemplary dimensions of the handle member 1000 include a height of approximately 32.43 inches and a width of approximately 14 inches. As best seen in FIG. 13, the handle member 1000 may further include at least one central support member 1300 coupled to the handle member 1000 and horizontally disposed in a perpendicular configuration with respect to the handle member 1000. The at least one central support member 1300 is designed to provide structural support to the attachment 100, particularly when the handle member 1000 is used to transport the cooler or is used as a backrest by a user sitting on the cooler. The handle member 1000 may be monolithic or, in alternate embodiments, may be comprised of several individual members mechanically or chemically coupled together, e.g., welded or glued together. Beneficially, the handle member 1000 is selectively removably couplable to the attachment 100 such that the handle member 1000 may be removed when it is ill-suited for the user's needs at any particular time and replaced back on the attachment 100 when it is needed.

Figure 8:
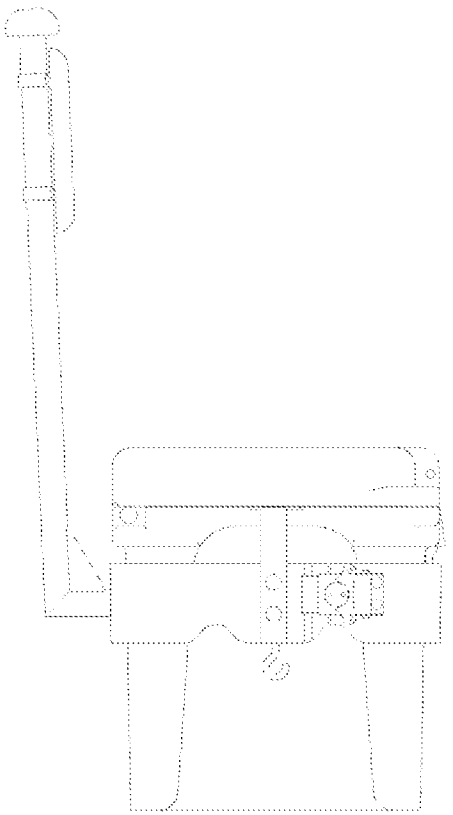
FIG. 8 is an elevational side view of an exemplary embodiment of the accessory support attachment with a back support frame member, in accordance with the present invention.
Figure 7:
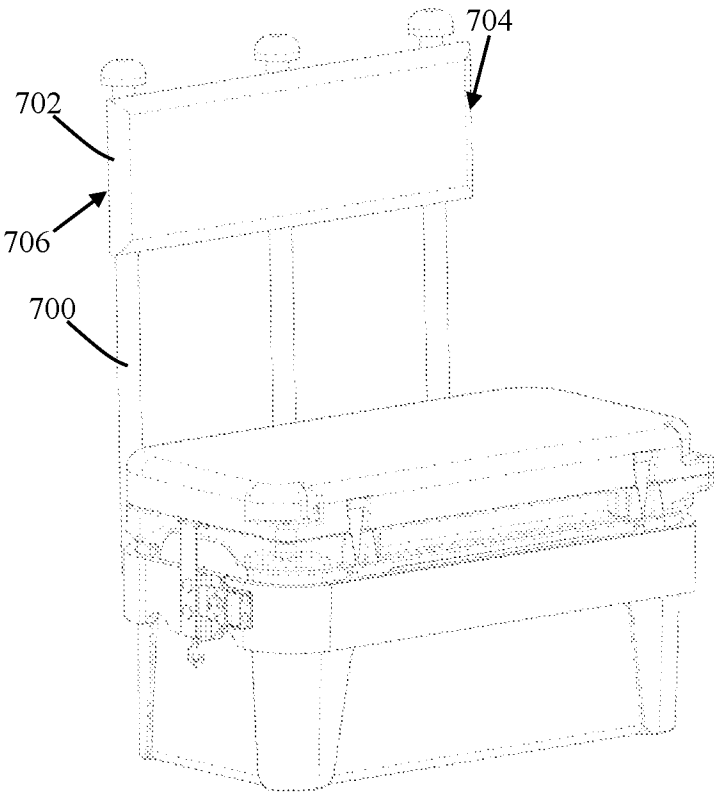
FIG. 7 is a perspective front view of the accessory support attachment with a back support frame member, in accordance with the present invention.
Figure 9:
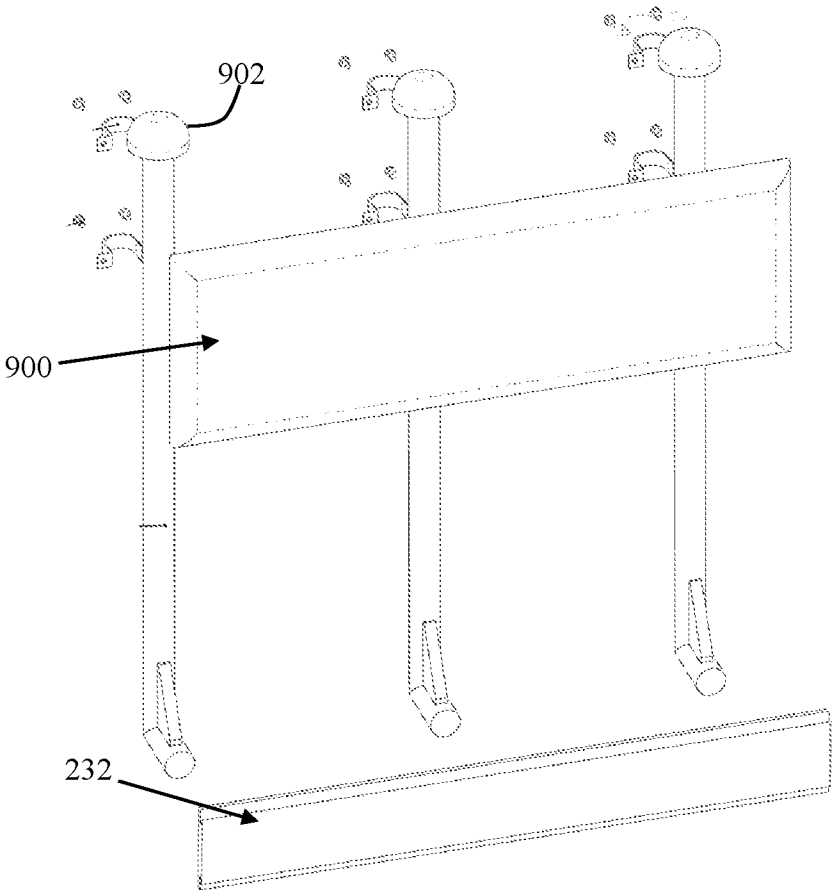
FIG. 9 is a partially exploded view of the back support frame member, in accordance with the present invention.
Figure 11:
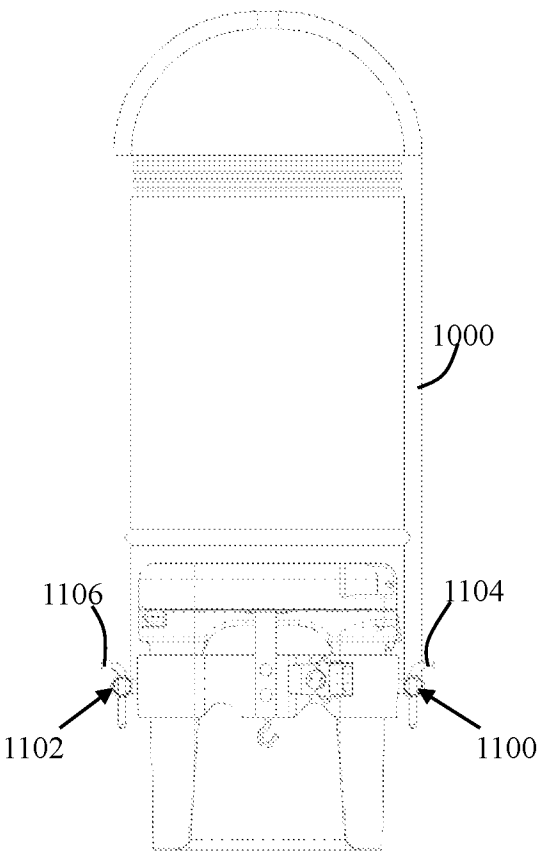
FIG. 11 is an elevational side view of an exemplary embodiment of an accessory support attachment with a handle member, in accordance with the present invention.
Figure 10:
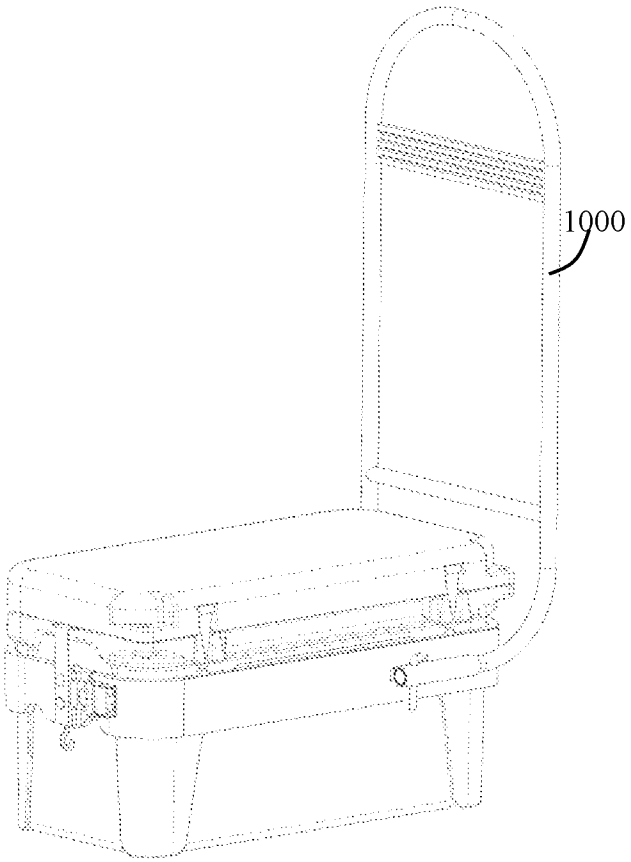
FIG. 10 is a perspective front view of the accessory support attachment with a handle member, in accordance with the present invention.

Referring now to FIGS. 7-9, the attachment 100 may further comprise a back support frame member 700 each angled outwardly and upwardly from the upper edge 200 of the support sidewall 102 and coupled to the accessory support member 232 in a cantilevered configuration, i.e., supported only on one end or side, the support frame member 700 having a deformably resilient pad 702 coupled thereto. In an exemplary embodiment, there are three back support frame members 700*a-c*, each one cylindrical in shape and vertically disposed in a perpendicular configuration with respect to the accessory support member 232 or the second accessory support member 234, depending on which accessory support member 232, 234 the back support frame members 700*a-c* are coupled to. The back support frame member 700 may be mechanically or chemically coupled, e.g., welded or glued, to the accessory support member 232 or the second accessory support member 234. In one embodiment, the back support frame member 700 forms a 92.6° angle with respect to the accessory support member 232. While the specific angle formed between the back support frame member 700 and the accessory support member 232 may vary in alternate embodiments, it should preferably be between 90° and 150° so as to support a user sitting on the cooler and resting their back on the back support frame member 700 and deformably resilient pad 702 coupled thereto. Exemplary dimensions of the back support frame member 700 include a height of approximately 23.01 inches and a diameter of approximately 1 inch. In a preferred embodiment (and as best seen in FIG. 9), the back support frame members 700*a-c* are equidistant from one another, with approximately 8 inches of free space between each back support frame member 700. The deformably resilient pad 702 is preferably disposed on 75% to 100% of the surface area of a front surface 900 of the back support frame member 700 to provide a greater level of comfort when a user is leaning back against the back support frame member 700. For this same reason, the deformably resilient pad 702 is located proximal to an upper end 902 of the back support frame member 700, wherein "proximal to" is defined as a distance of no more than 50% of the height of the back support frame member 700. In one embodiment, the deformably resilient pad 702 is of a foam upholstery foam with a leather cover thereon, though the specific material composition may vary in alternate embodiments. Preferably, however, the deformably resilient pad 702 should be of a substantially soft fabric or deformable material composition to provide a greater degree of comfort to a user leaning back, on, or against the deformably resilient pad 702 during use. In an exemplary embodiment, the back support frame member 700 is of an HDPE composition to provide a substantially rigid structure and frame and the upper end 902 of each back support frame member 700 includes a protective cap member that covers the free end of the back support frame member 700 to avoid injury and improve the aesthetic of the attachment 100.

As best depicted in FIG. 7, the deformably resilient pad 702 has two opposing ends 704, 706 defining a pad length separating the two opposing ends 704, 706 of the deformably resilient pad 702, the pad length at least 50% of the sidewall length 300. The pad length is approximately 21 inches in length in an exemplary embodiment of the present invention and, though the specific length may vary in alternate embodiments, the pad length should be of a length sufficient to support the entirety of a user's back, i.e., approximately equal to the width of a user's back. The pad length should be at least 50% of the sidewall length 300 to beneficially support the user's back during use. The deformably resilient pad 702 is of a height between approximately 6 inches and 8 inches to beneficially support a greater length of the user's back.

The attachment 100 also includes a cooler support latch 104 (as seen in FIG. 1) extending upwardly from the upper edge 200 of the support sidewall 102, coupled to the support sidewall 102, and having a U-shaped free end 236. The U-shaped free end 236 is operably configured to facilitate and support coupling of the attachment 100 to the cooler, i.e., the U-shaped free end 236 is placed over the upper edge of the cooler. Beneficially, the cooler support latch 104 ensures a stable attachment between the cooler and attachment 100.

As best seen in FIG. 1 and FIG. 3, the attachment 100 may further comprise a lower support hook 106 extending downwardly from the lower edge 202 of the support sidewall 102, coupled to the support sidewall 102, and having a U-shaped free end 108. The lower support hook 106 beneficially enables the selective placement of various items thereon, particularly during use of the cooler, e.g., hanging plastic bags, fishing line spools, etc. thereon. For improved durability, the lower support hook 106 is of a steel composition in one embodiment or of another substantially rigid and durable composition in alternate embodiments.

An improvement is also disclosed that is used in combination with a cooler 110 having a cooler bottom wall 112, a cooler sidewall 114 surrounding the cooler bottom wall 112 and defining, with the cooler bottom wall 112, an insulated cooling cavity, and a lid 116 selectively and removably coupled to the cooler sidewall 114 and operably configured to encapsulate, with the cooler sidewall 114 and cooler bottom wall 112, the insulated cooling cavity. In combination with the foregoing, the improvement comprises the attachment 100 having the support sidewall 102 of a substantially rigid material, and selectively removably couplable to the cooler sidewall 114 in a compression configuration, with the upper edge 200, with the lower edge 202 opposing the upper edge 200, with the inner surface 204, with the outer surface 206 opposing the inner surface 204 of the support sidewall 102, with the first portion 210 including the first portion first end 214 and the first portion second end 216 opposing the first portion first end 214, with the second portion 212 including the second portion first end 218 hingedly coupled to the first portion first end 214 and the second portion second end 220 opposing the second portion first end 218 and selectively and lockably couplable to the first portion second end 216 with the at least one support sidewall fastener assembly 222, and with the sidewall length 300 separating the first portion first end 214 and the first portion second end 216; and the accessory support member 232 selectively and slidably coupled to the outer surface 206 of the support sidewall 102 with a tongue-and-groove configuration, with the first accessory support first end 302, with the first accessory support second end 304, and with the accessory support length 306 separating the first accessory support first end 302 and the first accessory support second end 304, the accessory support length 306 at least 50% of the sidewall length 300.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. An accessory support attachment for coolers comprising:

a support sidewall:

with an upper edge, with a lower edge opposing the upper edge, with an inner surface, with an outer surface opposing the inner surface of the support sidewall;

with a first sidewall member including a first end, a second end opposing the first end of the first sidewall member, and a first member sidewall length separating the first and second ends of the first sidewall member; and with a second sidewall member including a first end hingedly coupled to enable the second sidewall member to swing respect to the first sidewall member, a second end opposing the first end of the second sidewall member and selectively, removably, and lockably couplable to the second end with at least one support sidewall fastener assembly to horizontally align the first sidewall member with respect to the second sidewall member, and a second member length separating the first and second ends of the second sidewall member, wherein the first and second sidewall members are made of a substantially rigid material separating the respective sidewall lengths of the first and second sidewall members such that the first and second sidewall members maintain their shape when the second end of the second sidewall member is uncoupled from the second end of the first sidewall member; and an accessory support member selectively and slidably coupled to the outer surface of the support sidewall with a tongue-and-groove configuration, with a first accessory support first end, with a first accessory support second end, and with an accessory support length separating the first accessory support first end and the first accessory support second end, the accessory support length at least 50% of the sidewall length.

2. The accessory support attachment for coolers according to claim 1, wherein the at least one support sidewall fastener assembly further comprising:

a rear plate mechanically coupled with at least one fastener to the first portion and proximal to the second portion second end;

a flange member extending radially outward from the outer surface of the second portion of the support sidewall and disposed proximal to the second portion second end; and a front plate translatably coupled to the rear plate and selectively and lockably couplable to the flange member.

3. The accessory support attachment for coolers according to claim 1, further comprising:

a second accessory support member selectively and slidably coupled to the outer surface of the second portion of the support sidewall with a tongue-and-groove configuration, with a second accessory support first end, with a second accessory support second end, and with a second accessory support length separating the second accessory support first end and the second accessory support second end, the second accessory support length at least 50% of the sidewall length and the accessory support member selectively and slidably coupled to the outer surface of the first portion of the support sidewall with the tongue-and-groove configuration.

4. The accessory support attachment for coolers according to claim 3, wherein:

the accessory support length and the second accessory support length are substantially equal.

5. The accessory support attachment for coolers according to claim 3, wherein:

the accessory support member is selectively and slidably coupled to the first portion and the second accessory support member is selectively and slidably coupled to the outer surface of the second portion on an opposing side of the support sidewall.

6. The accessory support attachment for coolers according to claim 5, wherein:

the accessory support member and the second accessory support member are oriented in a parallel configuration with one another.

7. The accessory support attachment for coolers according to claim 1, further comprising:

a cooler support latch extending upwardly from the upper edge of the support sidewall, coupled to the support sidewall, and having a U-shaped free end.

8. The accessory support attachment for coolers according to claim 1, further comprising:

a lower support hook extending downwardly from the lower edge of the support sidewall, coupled to the support sidewall, and having a U-shaped free end.

9. In combination with a cooler having a cooler bottom wall, a cooler sidewall surrounding the cooler bottom wall and defining, with the cooler bottom wall, an insulated cooling cavity, and a lid selectively and removably coupled to the cooler sidewall and operably configured to encapsulate, with the cooler sidewall and cooler bottom wall, the insulated cooling cavity, the improvement to the cooler comprising:

an accessory support attachment for coolers having:

a support sidewall:

selectively removably coupled to the cooler sidewall in a compression configuration;

with an upper edge, with a lower edge opposing the upper edge, with an inner surface, with an outer surface opposing the inner surface of the support sidewall;

with a first sidewall member including a first end, a second end opposing the first end of the first sidewall member, and a first member sidewall length separating the first and second ends of the first sidewall member; and with a second sidewall member including a first end hingedly coupled to the first end of the first sidewall member to to enable the second sidewall member to swing respect to the first sidewall member, a second end opposing the first end of the second sidewall member and selectively, removably, and lockably couplable to the second end with at least one support sidewall fastener assembly to horizontally align the first sidewall member with respect to the second sidewall member, and a second member length separating the first and second ends of the second sidewall member, wherein the first and second sidewall members are made of a substantially rigid material separating the respective sidewall lengths of the first and second sidewall members such that the first and second sidewall members maintain their shape and horizontal alignment when the second end of the second sidewall member is uncoupled from the second end of the first sidewall member; and an accessory support member selectively and slidably coupled to the outer surface of the support sidewall with a tongue-and-groove configuration, with a first accessory support first end, with a first accessory support second end, and with an accessory support length separating the first accessory support first end and the first accessory support second end, the accessory support length at least 50% of the sidewall length.

10. The improvement according to claim 9, further comprising:

a second accessory support member selectively and slidably coupled to the outer surface of the second portion of the support sidewall with a tongue-and-groove configuration, with a second accessory support first end, with a second accessory support second end, and with a second accessory support length separating the second accessory support first end and the second accessory support second end, the second accessory support length at least 50% of the sidewall length and the accessory support member selectively and slidably coupled to the outer surface of the first portion of the support sidewall with the tongue-and-groove configuration.

* * * * *